US010449463B2

(12) United States Patent
Sufer et al.

(10) Patent No.: US 10,449,463 B2
(45) Date of Patent: Oct. 22, 2019

(54) INTERACTIVE ROBOTIC TOY

(71) Applicant: WowWee Group Ltd., TST East (HK)

(72) Inventors: Davin Sufer, Montreal (CA); Anthony Lemire, Montreal (CA); Sydney Wiseman, Montreal (CA)

(73) Assignee: WOWWEE GROUP LTD., TST East (HK)

( * ) Notice: Subject to any disclaimer, the term of this patent is extended or adjusted under 35 U.S.C. 154(b) by 0 days.

(21) Appl. No.: 15/802,578

(22) Filed: Nov. 3, 2017

(65) Prior Publication Data

US 2018/0326312 A1 Nov. 15, 2018

Related U.S. Application Data

(60) Provisional application No. 62/503,363, filed on May 9, 2017.

(51) Int. Cl.

| | |
|---|---|
| ***A63H 3/28*** | (2006.01) |
| ***A63H 3/40*** | (2006.01) |
| ***A63H 3/14*** | (2006.01) |
| ***A63H 3/00*** | (2006.01) |

(52) U.S. Cl.

CPC ..... *A63H 3/28* (2013.01); *A63H 3/001* (2013.01); *A63H 3/14* (2013.01); *A63H 3/40* (2013.01); *A63H 2200/00* (2013.01)

(58) Field of Classification Search

CPC . A63H 3/003; A63H 3/14; A63H 3/28; A63H 3/40; A63H 3/48; A63H 2200/00

USPC ..... 446/72, 81, 98, 102, 175, 268, 297, 298, 446/300, 301, 330

See application file for complete search history.

(56) References Cited

U.S. PATENT DOCUMENTS 3,034,258 A * 5/1962 Schwartz ..... A63H 3/006 446/327
3,916,561 A * 11/1975 Kato ..... A63H 3/31 446/190

(Continued)

FOREIGN PATENT DOCUMENTS

CA 2881553 A1 8/2016
CN 101329558 A 12/2008

(Continued)

*Primary Examiner* — Alexander R Niconovich
(74) *Attorney, Agent, or Firm* — Epstein Drangel LLP; Robert L. Epstein

(57) ABSTRACT

The toy includes a body section including flexible limbs and a head section rotatably coupled with the body section having eyes and eye lids. A speaker and a motor to rotate the head section are provided along with an eyes blink actuator which moves the eye lids. A touch sensor and a sound sensor for detecting sound in the vicinity of the toy are included. A rotational motion sensor detects rotational motion of the toy about selected axes. A memory is provided for storing a plurality of physical animations. A processor, coupled with the speaker, motor, eyes blink actuator, touch sensor, sound sensor, rotation motion sensor and the memory, selects at least one physical animation corresponding to signals received from the touch sensor, sound sensor and rotational motion sensor. The processor produces signals corresponding to the selected physical animation for the speaker, the motor and/or the eyes blink actuator.

25 Claims, 8 Drawing Sheets

(56) References Cited

Figure 1A:
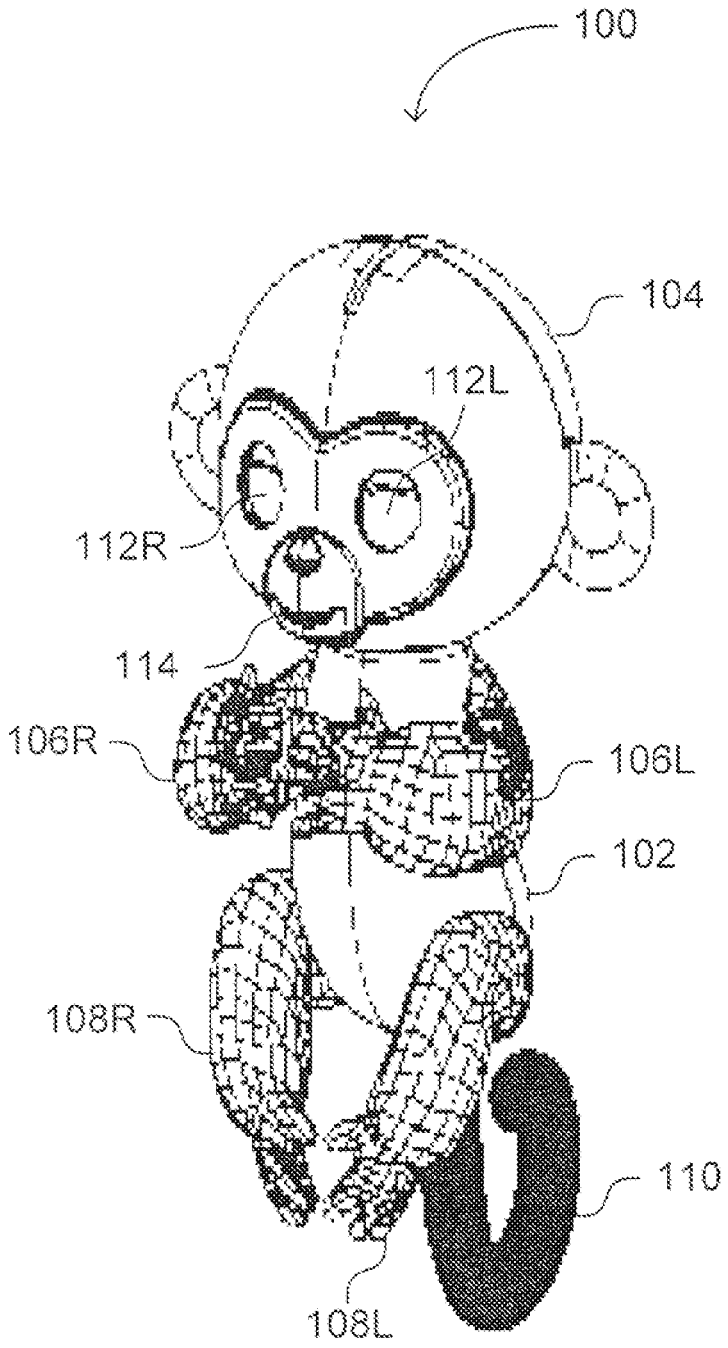

U.S. PATENT DOCUMENTS 4,280,292 A * 7/1981 Hills ..... A63H 3/14 40/538
4,610,640 A * 9/1986 Amici ..... A63H 3/18 446/329
4,687,457 A * 8/1987 Milner ..... A63H 3/28 446/175
4,802,879 A * 2/1989 Rissman ..... A63H 3/28 446/101
5,267,886 A * 12/1993 Wood ..... A63H 3/006 446/175
5,413,516 A * 5/1995 Lam ..... A63H 3/28 446/301
5,415,579 A * 5/1995 Pracas ..... A63H 3/28 446/295
5,752,880 A * 5/1998 Gabai ..... A63H 30/04 434/308
5,791,965 A * 8/1998 Kim ..... A63H 3/006 446/219
5,902,169 A * 5/1999 Yamakawa ..... A63H 3/48 446/337
6,149,490 A * 11/2000 Hampton ..... A63H 3/28 446/298
6,171,172 B1 * 1/2001 Foster ..... A63H 11/12 446/270
6,200,188 B1 * 3/2001 Filo ..... A63H 5/04 446/175
6,322,420 B1 * 11/2001 Daniellian ..... A63H 3/36 446/300
6,371,826 B1 * 4/2002 Pestonji ..... A63H 3/48 446/298
6,394,874 B1 * 5/2002 Kubo ..... A63H 3/14 446/321
6,565,407 B1 * 5/2003 Woolington ..... A63H 3/28 446/175
6,890,239 B2 * 5/2005 Kopelle ..... A63H 3/28 434/236
6,971,943 B1 * 12/2005 Schulze ..... A63H 3/14 446/175
7,029,361 B2 * 4/2006 Seibert ..... A63H 3/14 446/26
7,442,107 B1 * 10/2008 Ueda ..... A63H 11/20 446/175
8,062,087 B1 * 11/2011 Davis ..... A63H 3/003 446/26
8,545,283 B2 * 10/2013 Richter ..... A63H 3/28 446/268
9,108,115 B1 * 8/2015 Fung ..... A63H 3/28
2001/0029147 A1 * 10/2001 Hornsby ..... A63H 11/20 446/356
2005/0085157 A1 * 4/2005 Dahlquist ..... A63H 11/10 446/268
2012/0022688 A1 * 1/2012 Wong ..... G06N 3/008 700/253
2013/0078600 A1 * 3/2013 Fischer ..... G09B 19/00 434/236
2018/0333862 A1 * 11/2018 Hayashi ..... A63H 11/10

FOREIGN PATENT DOCUMENTS

CN 101745230 A 6/2010
CN 101890239 A 11/2010
CN 204891193 U 12/2015
CN 105983239 A 10/2016
CN 207575776 U 7/2018
JP H0780159 A 3/1995
JP 2003024654 A 1/2003

* cited by examiner

INTERACTIVE ROBOTIC TOY

CROSS-REFERENCE TO RELATED APPLICATIONS

Priority is claimed on U.S. Provisional Patent Application No. 62/503,363, filed on May 9, 2017, the entire contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to toys in general, and in particular to an interactive robotic toy.

2. Description of Prior Art Including Information Disclosed Under 37 CFR 1.97 and 1.98

Toys that cling to fingers and finger puppets are known in the art. Such toys provide entertainment to children and adults. U.S. Pat. No. 7,029,361 to Seibert et al, entitled "Finger puppets with sounds" directs to a toy being held on or by a finger, which includes a body having a top end and a bottom end, and means for mounting the toy on a finger coupled to the body. The toy also includes a computer chip and a speaker, within the body, for generating sound. The toy further includes a switch electrically connected to the computer chip and a finger tapper movably mounted to the bottom end of the body. When the finger tapper is depressed, the switch is actuated to cause the generation of the sound.

However, there is no interactive robotic toy which can cling to a finger of a person or which exhibits a plurality of physical animations in response to user actions, such as kissing, cradling, hanging upside down, petting and the like. There are no interactive robotic toys wherein the physical animation is a combination of sound and motion and include head motion, eyes blinking or sound animations (e.g., sound of laughing, sound of sneezing, sound of a kiss and the like).

BRIEF SUMMARY OF THE INVENTION

It is, therefore, a prime object of the present invention to provide an interactive robotic toy which can cling to a finger of a person.

It is another object of the present invention to provide robotic toy exhibits a plurality of physical animations in response to user actions.

It is another object of the present invention to provide robotic toy which exhibits a plurality of physical animations in response to user actions including kissing, cradling, hanging upside down, petting and the like.

It is another object of the present invention to provide robotic toy exhibits a plurality of physical animations including a combination of sound and motion and may include head motion, eyes blinking or sound animations (e.g., sound of laughing, sound of sneezing, sound of a kiss and the like).

In accordance with the present invention, an interactive robotic toy is provided. The toy includes a body section including flexible limbs and a head section, rotatably coupled with the body section. The head section includes eyes and respective eye lids, operable to cover and uncover the eyes. The toy also includes a speaker, operative to produce sounds and a motor, operative to rotate the head section relative to the body section. The toy also includes an eyes blink actuator, operable to move the eye lids such that eye lids cover and uncover said eyes.

The toy further includes at least one touch sensor for detecting touch and at least one sound sensor for detecting sound in the vicinity of the toy.

At least one rotational motion sensor is provided for detecting rotational motion of the toy about selected axes. A memory is provided for storing a plurality of physical animations.

Further, a processor, coupled with the speaker, the motor, the eyes blink actuator, the touch sensor, the sound sensor, the rotation motion sensor and the memory is provided for selecting at least one physical animation corresponding to signals received from the touch sensor, the sound sensor and the rotational motion sensor. The processor produces signals corresponding to the selected physical animation for the speaker, the motor and/or the eyes blink actuator.

BRIEF DESCRIPTION OF THE SEVERAL VIEWS OF DRAWINGS

Figure 1B:
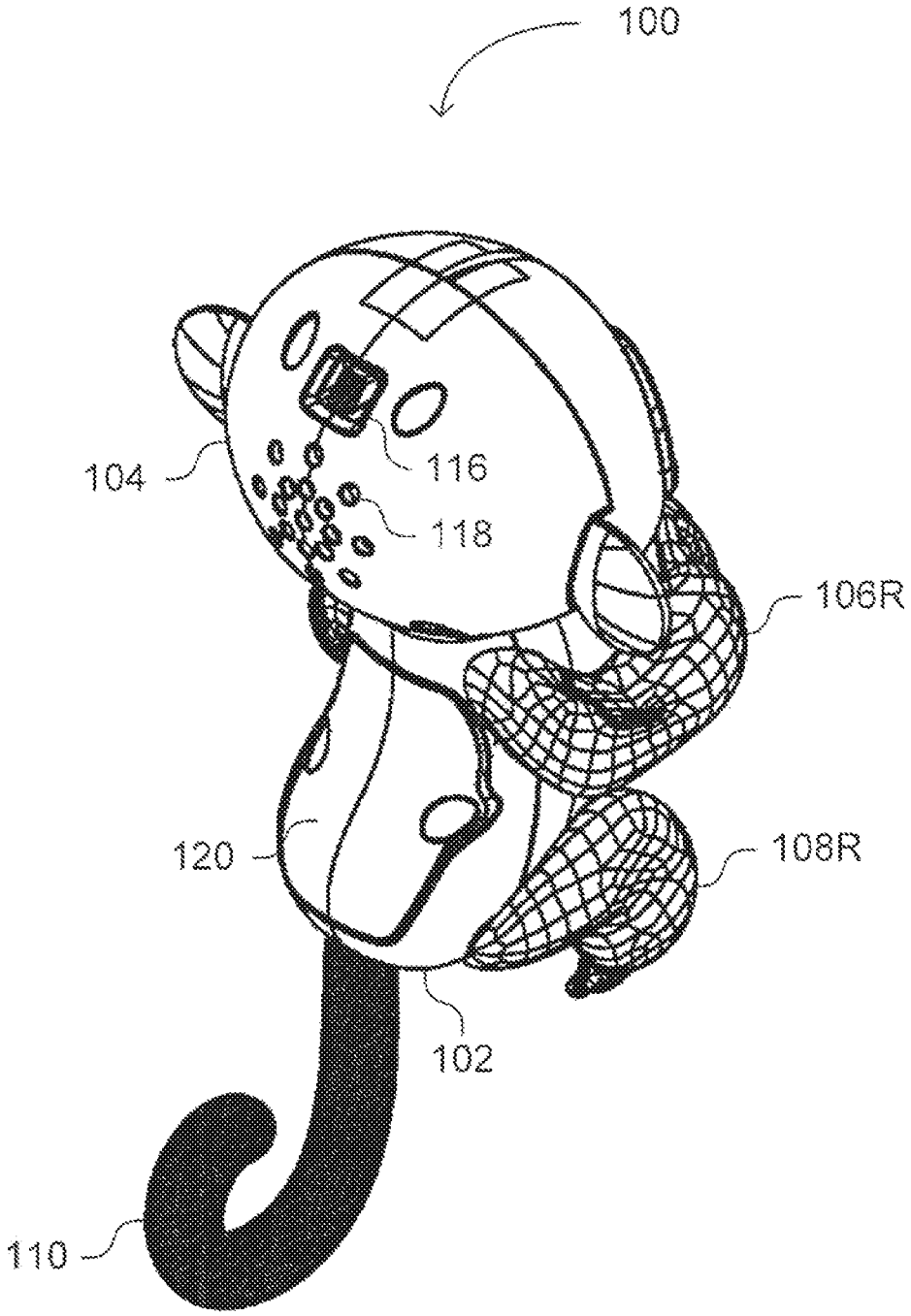
Figure 1C:
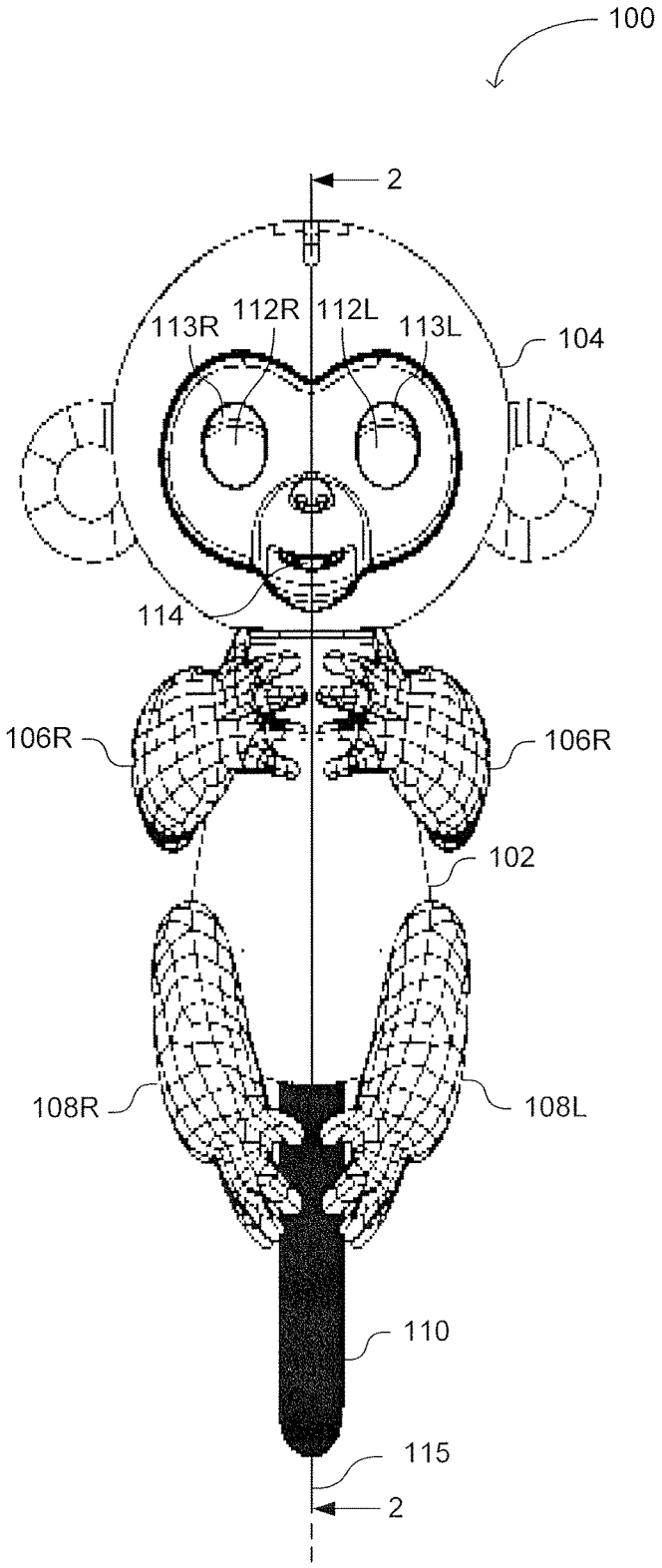
Figure 1D:
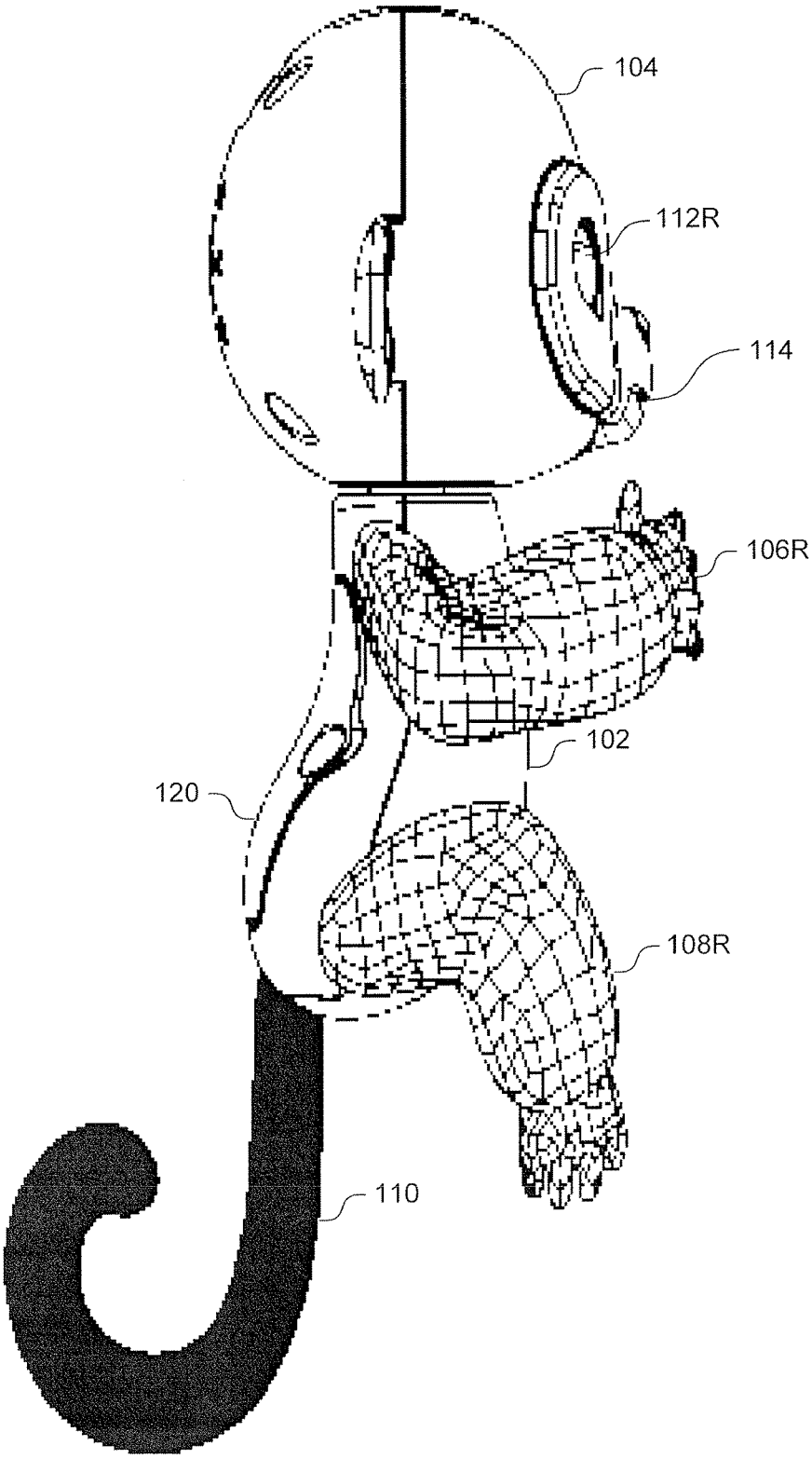
Figure 1E:
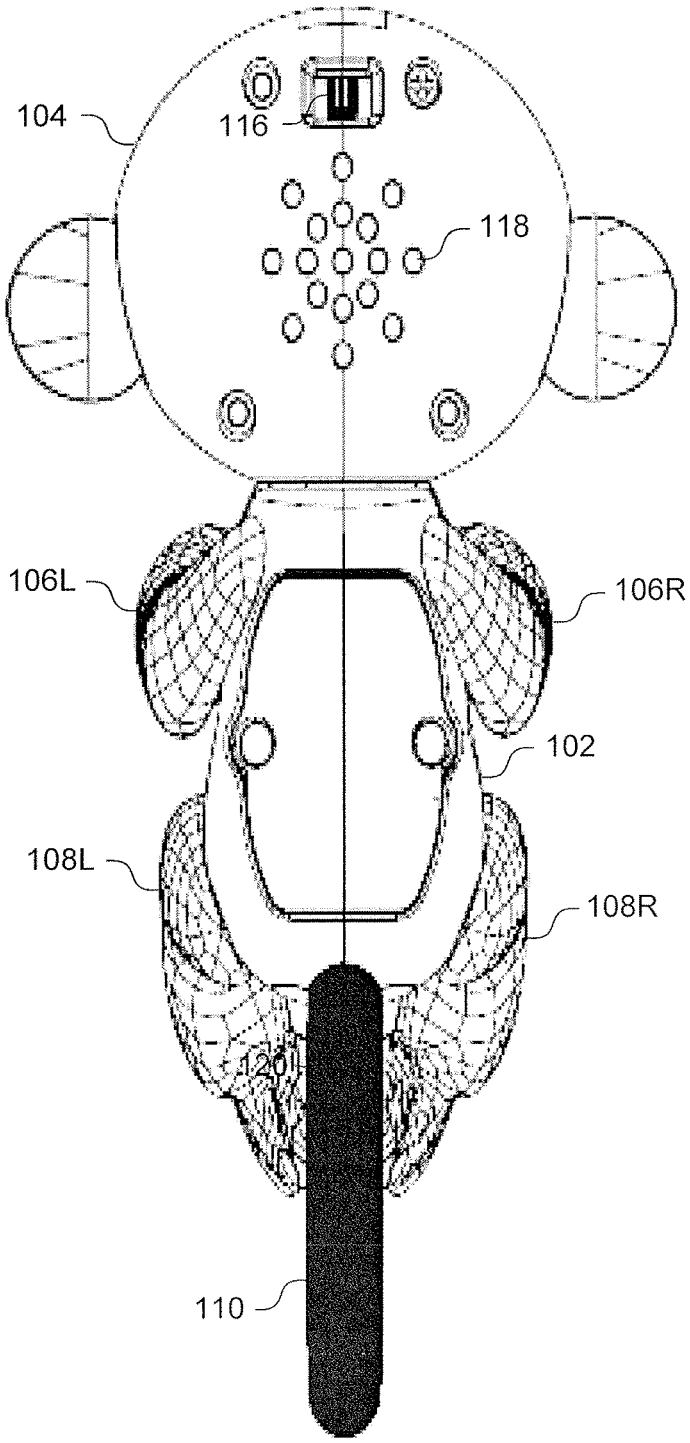
Figure 1F:
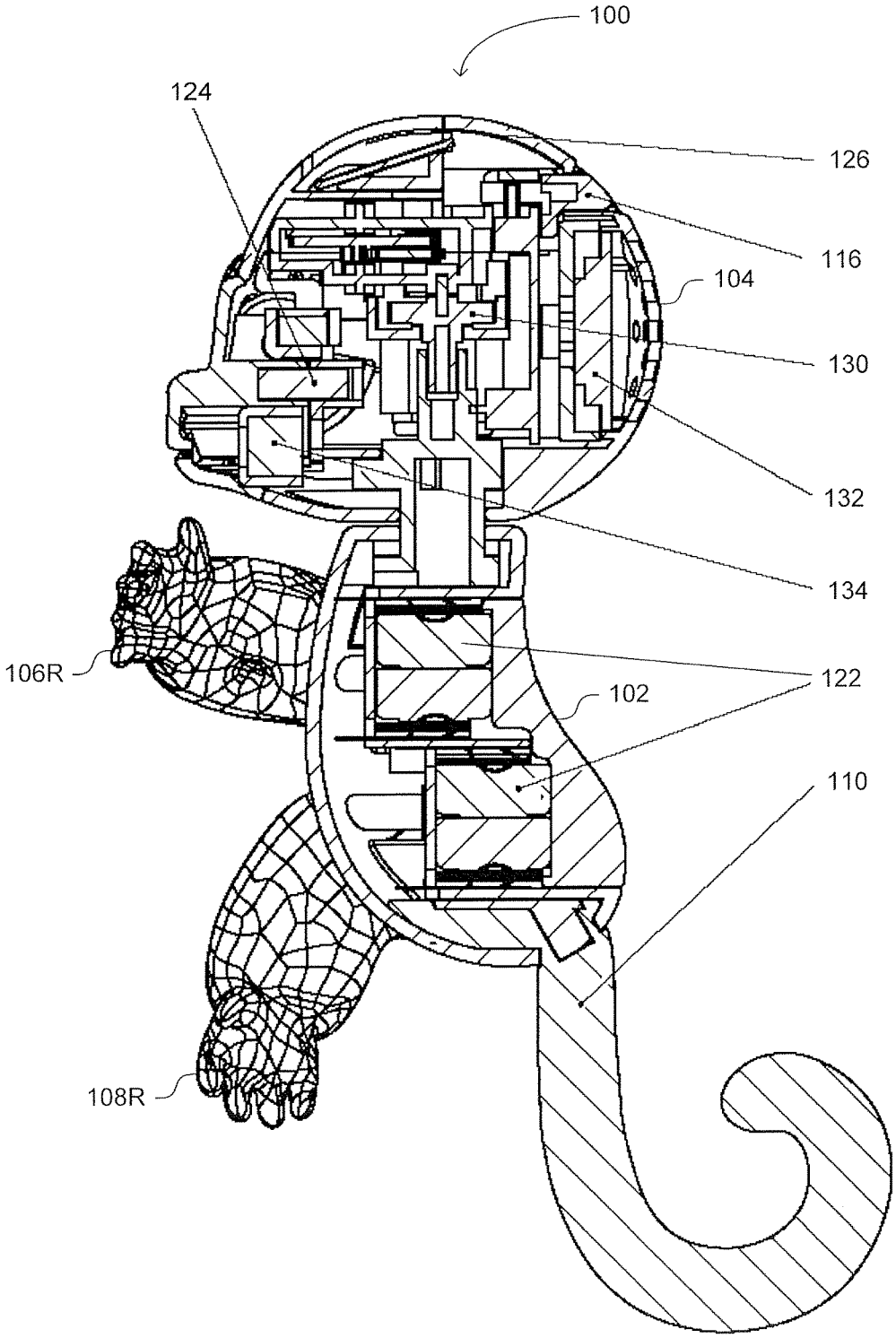
Figure 1G:
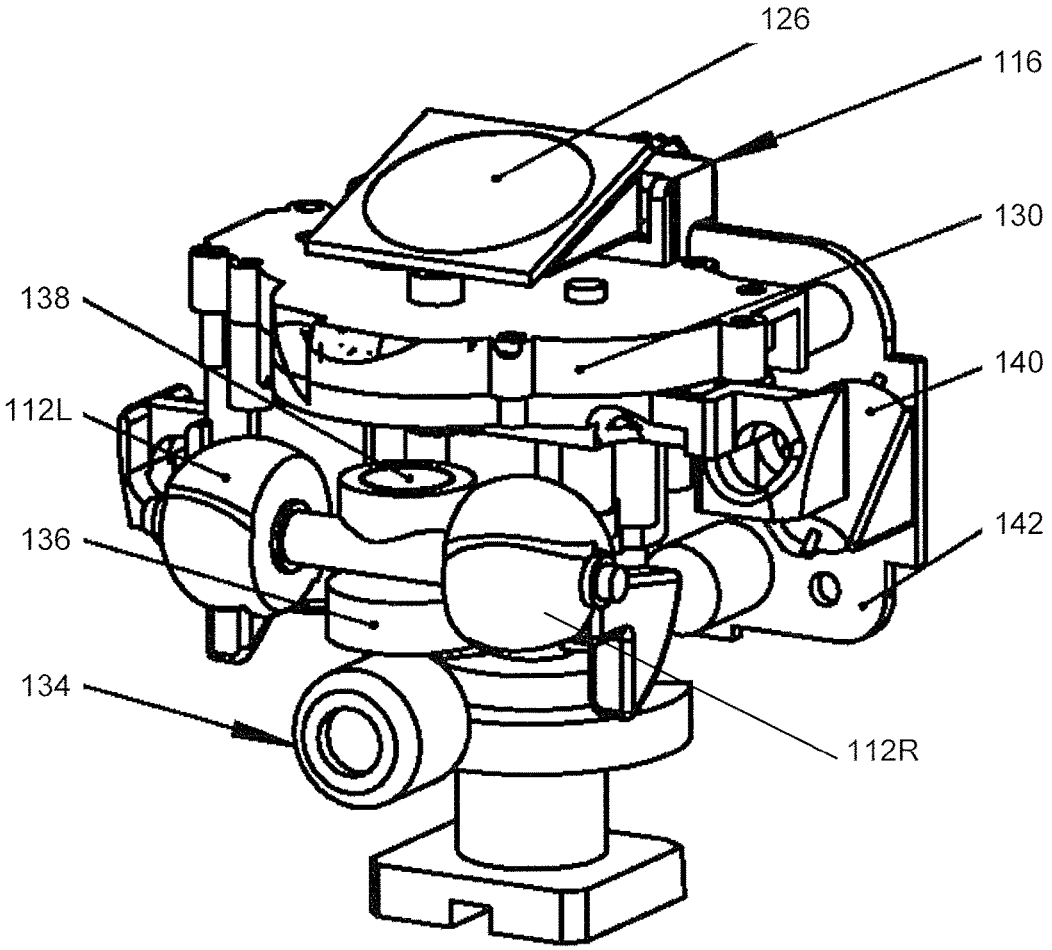
Figure 2:
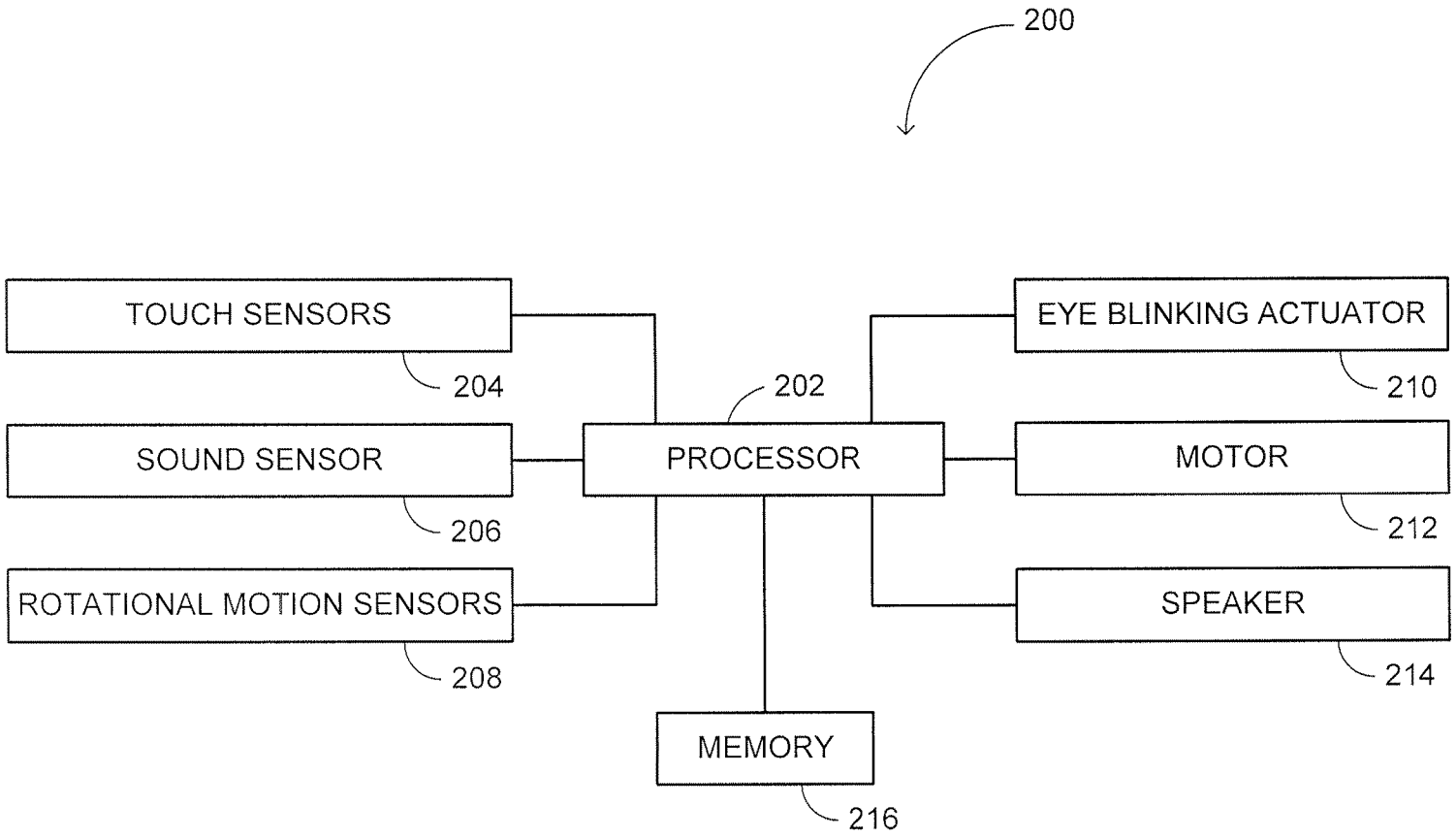

To these and to such other objects that may hereinafter appear, the present invention relates to an interactive robotic toy as described in detail in the following specification and recited in the annexed claims, taken together with the accompanying drawings, in which like numerals refer to like parts and in which:

FIGS. 1A-1G are schematic illustrations of interactive robotic toy, constructed and operative in accordance with a preferred embodiment of the present invention; and FIG. 2 is a block diagram showing the components the preferred embodiment of the interactive robotic toy of the present invention.

DETAILED DESCRIPTION OF THE INVENTION

The disclosed technique overcomes the disadvantages of the prior art by providing an interactive robotic toy which can cling to a finger of a person. The robotic toy exhibits a plurality of physical animations in response to user actions. Such actions may include kissing, cradling, hanging upside down, petting and the like. The physical animation is a combination of sound and motion and may include head motion, eyes blinking or sound animations (e.g., sound of laughing, sound of sneezing, sound of a kiss and the like).

Reference is now made to FIGS. 1A-1E, which is a schematic illustration of an interactive robotic toy, generally referenced 100, constructed and operative in accordance with an embodiment of the disclosed technique. FIG. 1A is an isometric front view of Interactive robotic toy 100. FIG. 1B is an isometric front back of Interactive robotic toy 100. FIG. 1C is a front view of Interactive robotic toy 100. FIG. 1D is a side view of Interactive robotic toy 100 and FIG. 1E is a back view of Interactive robotic toy 100.

Interactive robotic toy 100 includes a body section 102 and a head section 104 rotatably coupled with body section 102. Interactive robotic toy 100 further includes flexible left and right arms 106L and 106R respectively, flexible left and right legs 108L and 108R respectively and a flexible tail 110. Flexible left and right arms 106L and 106R, flexible left and right legs 108L and 108R and flexible tail 110 are all coupled with body section 102. Body section 102 further includes a batteries cavity in which batteries are located, covered by a batteries covered 120.

Head section 104 includes left and right eyes 112L and 112R, a mouth opening 114, an on-off switch 116 and loudspeaker holes such as hole 118. Left and right eyes 112L and 112R may be embodied as spheres rotating about an axis perpendicular to axis 115. Half of the spheres are of a color similar to the body color of interactive robotic toy 100 (i.e., emulating eye lids). This half is referred to herein as the "lids side". The other half of the sphere are of a dark color (e.g., black) thus emulating the eyes, referred to as the "eyes side".

When left and right eyes 112L and 112R are rotated such that the eyes side thereof are facing the user, left and right eyes 112L and 112R appear to be open. When left and right eyes 112L and 112R are rotated such that the lids side thereof are facing the user, left and right eyes 112L and 112R appear to be closed. Alternatively, left and right eyes 112L and 112R include respective left and right eye lids 113L and 113R operable to cover or uncover the respective left and right eyes 112L and 112R (i.e., close or open left and right eyes 112L and 112R).

Interactive robotic toy 100 may cling to a finger of a user via the flexible limbs thereof (i.e., left and right arms 106L and 106 R, left and right legs 108L and 106 R or tail 110). A cross sectional view of interactive robotic toy 100 is depicted in FIG. 1E.

As mentioned above, interactive robotic toy 100 includes a plurality of physical animations in response to various actions by the user. For example, when interactive toy 100 is turned on, interactive robotic toy 100 may sound a laugh, and blink. When hanged upside down via tail, interactive robotic toy 100 may produce sounds associated with excitement. When cradled, interactive robotic toy 100 may produce sounds associated with content and close eyes 112L and 112R.

With reference to FIGS. 1E and 1G, the system operating interactive robot toy 100 is located within head section 104. The power supply (e.g., batteries) operating the system are located within body section 102. The system operating interactive robotic toy 100 includes an eyes blink actuator 124, at least one touch sensor 126, a motor and gears 130, a speaker 132 attached to a PCB 142 and at least one sound sensor 134 (e.g., microphone) and at least one orientation sensor 140 (e.g., ball switch, gyroscope, Accelerometer). Eyes blink actuator 124 includes a solenoid 136 and a magnet 138. The operation of the system operating an interactive robotic toy such as interactive robotic toy 100 is further explained in conjunction with FIG. 2.

Reference is now made to FIG. 2, which is a schematic illustration of a system, generally referenced 200, for operation of the an interactive robotic toy. System 200 includes a processor 202. System 200 further includes at least one touch sensor 204, at least one sound sensor 206, an orientation sensor 208, an eyes blink actuator 210, a motor 212, a speaker 214 and a memory 216 all coupled with processor 202. Eyes blink actuator 210 may be embodied as a solenoid and a magnet or as a motor and gears. Touch sensor 204 is, for example, a capacitive touch sensor. Sound sensor 206 may be embodied as a microphone.

Orientation sensor 208 is, for example, at least one ball switch, a gyroscope or an accelerometer, detecting information relating to the orientation of interactive robotic toy 200 about selected axes. Memory 216 stores a plurality of physical animations for interactive robotic toy. A physical animation is defined as a combination of sound animation and motion animation. A motion animation is, for example, the motion of the head and the blinking of the eyes of the interactive robotic toy.

Touch sensor 204 detects touch, for example, on the head section of the interactive robotic toy, produces a signal indicative that the head section was touched and provides that signal to processor 202. Orientation sensor 208 detects information relating to the orientation of interactive robotic toy 200, produces a signal or signals respective of this information. Sound sensor 208 detects sound in the vicinity of the interactive toy, produces a signal indicative to that sound and provides this signal to processor 202. As mentioned above, interactive robotic toy may include two or more sound sensors, which define an array of microphones.

Processor 202 receives the signals produced by touch sensor 204, sound sensor 206 and orientation sensor 208. Processor 202 determines when interactive robotic toy 200 was touched according to the signal received from touch sensor 204. Processor 202 determines when a sound was made in the vicinity of interactive robotic toy 200 and the nature of this sound (e.g., the detected sound is a sound of a kiss). For example, processor 202 compares the time signature or the frequency signature (e.g., a Fourier Transform of the time signal) or both to stored signatures. When an array of microphones is employed processor 202 may further determine the direction from which the sound arrived at interactive robotic toy 200, for example, by employing interferometry techniques or correlation based techniques (e.g., Multiple Signal Classification—MUSIC).

Processor 202 selects a physical animation or animations associated with the received signals and the information (e.g., nature of the received sound received, direction or arrival of the received sound or the orientation of interactive robotic toy 200) derived therefrom. Once processor 202 selects the physical animation or animations, processor 202 produces corresponding signal to eyes blink actuator 210, motor 212 and speaker 214 to produce the selected animation.

For example, when the interactive robotic toy is held upright and touched on the head, motor 212 moves the head from side to side and speaker 214 produces a laughing sound. As a further example, when the interactive robotic toy is held horizontally (e.g., cradled) eyes blink actuator 210 rotates the eyes or the eye lids such that the eyes of the interactive robotic toy appear closed and speaker 214 produces a snoring sound. As another example, when the interactive toy is held upside down, then eyes blink actuator 210 rotates the eyes or the eye lids such that the eyes of the interactive robotic toy appear and speaker 214 produce a sound associated with excitement (e.g., a "Yehh" cry). As yet another example, when a user kisses the interactive robotic toy (i.e., sound sensor 206 detects the sound of a kiss), the speaker 214 produces the sound of a kiss. Furthermore, when an array of microphones is employed and the direction of arrival of the sound is determined, motor 212 rotates the head of the interactive robotic toy to turn toward the direction from which the sound arrived.

While only a single preferred embodiment of the present invention has been disclosed for purposes of illustration, it is obvious that many modifications and variations could be made thereto. It is intended to cover all of those modifications and variations which fall within the scope of the present invention, as defined by the following claim:

We claim:

1. An interactive robotic toy comprising:

a body section having an axis, a left side and a right side, a first pair of flexible limbs adapted to cling to a finger of the user, said limbs extending from said left side and said right side of said body section, respectively, and comprising unattached ends, said unattached ends of said limbs being and remaining spaced from each other when the limbs cling to the user's finger;

a head section coupled with said body section for rotation about said body section axis, a motor operative to rotate said head section relative to said body section about said body section axis;

a touch sensor for detecting touch;

a sound sensor for detecting sound in the vicinity of said interactive robotic toy;

a rotational motion sensor for detecting rotational motion of said interactive robotic toy about selected axes;

a memory for storing a plurality of physical animations;

a processor, coupled with said motor, said touch sensor, said sound sensor, said rotation motion sensor and with said memory, for selecting at least one stored physical animation corresponding to signals received from said touch sensor, said sound sensor and said rotational motion sensor, and for producing signals corresponding to said selected physical animation to operate said motor to rotate said head section relative to said body section about said body section axis.

2. The interactive robotic toy according to claim 1, further comprising a speaker connected to said processor operative to produce sounds, wherein the sounds comprise sound of laughing, sound of sneezing, and/or sound of a kiss.

3. The interactive robotic toy according to claim 1, wherein said head section comprises eyes and respective eye lids operable to cover and uncover the eyes; an eyes blink actuator, operable to move said eye lids to enable said interactive robotic toy to perform said motion of eye lids covering and uncovering said eyes.

4. The interactive robotic toy according to claim 3, wherein said eyes blink actuator comprises a solenoid and a magnet or comprises a motor and gears.

5. The interactive robotic toy according to claim 1, wherein said touch sensor is a capacitive touch sensor and said sound sensor is a microphone.

6. The interactive toy according to claim 1, wherein said touch sensor, said sound sensor and said rotational motion sensor are located within said head section.

7. The interactive toy according to claim 1, wherein the interactive toy further comprises a power supply which electrically connected to said motor, said speaker, said sound sensor and said processor to power them.

8. The interactive toy according to claim 1, wherein said power supply is one or more batteries located within said body section.

9. The interactive toy according to claim 1, wherein said head section further comprises an ear(s), a nose, a mouth and/or a hair(s).

10. The interactive toy according to claim 1, wherein the interactive toy is shaped as a monkey.

11. The interactive toy according to claim 1, wherein said at least one limb comprises curled part for clinging to said finger of said user.

12. The toy of claim 1 wherein each of said limbs of said first pair has a first section and a second section, said first sections of said limbs of said first pair extending in substantially parallel directions from said body section.

13. The toy of claim 1 wherein each of said limbs of said first pair has a first section and a second section, said second sections of said limbs of said first pair extending toward each other.

14. The toy of claim 1 wherein each of said limbs of said first pair has a first section and a second section, said first sections of said limbs of said first pair extending in substantially parallel directions from said body section, said second sections of said limbs of said first pair extending from said first sections of said limbs of said first pair toward each other.

15. The toy of claim 1 wherein said limbs of said first pair and said body section define an opening adapted to receive a finger of the user.

16. The toy of claim 1 wherein each of said limbs of said first pair comprises an arm.

17. The toy of claim 1 wherein each of said unattached ends of said limbs of said first pair comprises a hand.

18. The toy of claim 1 further comprising a second pair of spaced flexible limbs extending from said body section adapted to cling to the finger of the user.

19. The toy of claim 18 wherein said first pair of limbs and said second pair of limbs are spaced from each other along said body section.

20. The toy of claim 18 wherein each of said second pair of limbs comprises a leg.

21. The toy of claim 1 wherein said body section has a bottom and further comprising a flexible member extending from said bottom of said body section.

22. The toy of claim 21 wherein said flexible member comprises a tail.

23. An interactive robotic toy comprising:

a body section having an axis, a left side and a right side, a first pair of flexible limbs adapted to cling to a finger of the user, said limbs extending from said left side and said right side of said body section, respectively, and comprising unattached ends, said unattached ends of said limbs being and remaining spaced from each other when the limbs cling to the user's finger;

a body section having an axis and a head section coupled with said body section for rotation about said body section axis;

a motor capable of rotating said head section relative to said body section axis, sound sensors capable of detecting an external sound having a direction;

a processor, coupled to said sound sensors, capable of determining said direction of said detected external sound relative to said toy and causing said motor to rotate said head section relative to said body section axis in accordance with the direction of said detected external sound.

24. The interactive toy according to claim 23, wherein said head section comprises eyes and respective eye lids operable to cover and uncover the eyes; an eyes blink actuator, operable to move said eye lids to enable said interactive robotic toy to perform said motion of eye lids covering and uncovering said eyes.

25. The interactive toy according to claim 24, wherein said eyes blink actuator comprises a solenoid and a magnet or comprises a motor and gears.

* * * * *